US006026597A

United States Patent [19]

Burnet et al.

[11] Patent Number: 6,026,597

[45] Date of Patent: Feb. 22, 2000

[54] BLADE FOR SNOWSHOES AND SNOWSHOE OUTFITTED FOR A BLADE

[75] Inventors: Christophe Burnet, Saint Martin de Bellevue; Daniel Charvat, Thones, both of France

[73] Assignee: Techniques Sports Loisirs, Alex, France

[21] Appl. No.: 09/167,232

[22] Filed: Oct. 6, 1998

[30] Foreign Application Priority Data

Oct. 7, 1997 [FR] France ..... 97 12741
Dec. 22, 1997 [FR] France ..... 97 16598

[51] Int. Cl.[7] ..... A43B 5/04
[52] U.S. Cl. ..... 36/124
[58] Field of Search ..... 36/122–125

[56] References Cited

U.S. PATENT DOCUMENTS

| | | | |
|---|---|---|---|
| 4,720,927 | 1/1988 | Abegg | 36/122 |
| 5,540,002 | 7/1996 | Liautaud | 36/122 |
| 5,553,403 | 9/1996 | McManus | 36/124 |
| 5,687,491 | 11/1997 | Klebahn | 36/125 X |
| 5,809,667 | 9/1998 | Liautaud | 36/125 X |

FOREIGN PATENT DOCUMENTS

| | | |
|---|---|---|
| 0 736 312 | 10/1996 | European Pat. Off. . |
| 2742347 | 6/1997 | France . |
| WO 97/28860 | 8/1997 | WIPO . |

*Primary Examiner*—B. Dayoan

[57] ABSTRACT

A snow shoe (1) has a longitudinal support structure or ridge (18) surrounded by a screen (4). The longitudinal ridge defines a plurality of apertures (180*a*, 180*b*, 180*c*), an upper surface (20), and lower projecting surfaces (21*a*, 21*b*, 25*a*, 25*b*). A detachable blade or knife (30) includes a central projection (33) which extends through the aperture in the central ridge and mates with portions of the lower ridge which define the aperture. The blade includes a rearward extending tab (330*a*) which extends through the aperture and engages the upper wall of the central ridge. A rivet or other pivot pin (34) pivotally holds a bar (35) to the upper projection of the blade. When the upper projection is received in the aperture, the bar pivots to engage the upper surface of the central ridge. A plurality of knives or teeth (36*a*, 36*b*, 36*c*, 36*d*, 37*a*, 37*b*, 37*c*, 37*d*) extend downward to engage ice or packed snow.

15 Claims, 8 Drawing Sheets

BLADE FOR SNOWSHOES AND SNOWSHOE OUTFITTED FOR A BLADE

BACKGROUND OF THE INVENTION

The present invention concerns a blade for installation in detachable fashion on a snowshoe. It also relates to a snowshoe for fitting with said blade.

Snowshoes are instruments which have been known for a great many years. They have been employed by the Scandinavian population for several centuries in order to travel on snow. Up to the present time, snowshoes have been used for utilitarian or military purposes, so as to allow the population or mountain troops to move on snow or for traveling as required by their everyday lives Currently, snowshoes are mostly used by athletes for cross-country travel or hiking, or even for competitive events. Athletes, however, although they engage in athletic activity for their pleasure, are more and more demanding with respect to the equipment which they use, and, as a matter of fact, products which are currently sold are not proving totally satisfactory.

Thus, snowshoes must combine stopping and lifting criteria while still retaining maximum comfort for the user, in addition, the combination of these criteria take on particular importance under difficult practice conditions, such as, for example on hard snow or icy snow or with steep slopes. Current snowshoes, unfortunately, do not allow for obtaining an adequate foothold under such conditions and they do little for easing the user's movement. In addition, it may also be necessary to lessen the foothold of the shoe under certain types of utilization of the shoe or certain snow conditions, for example during downhill use.

The present invention proposes to resolve the aforementioned drawbacks by simple, reliable, safe and reasonably priced means. It presents an improvement with respect to snowshoes which permits adaption of the shoe to snow and slope conditions, thanks to surface holding means, such as a blade. Said means are fitted, preferably in detachable form, under the snowshoe as needed and if so desired by the user.

SUMMARY OF THE INVENTION

According to the invention the blade for the snowshoe is characterized in that it comprises installation means for permitting its installation, in detachable form, on the shoe.

According to a complementary characteristic of the blade, which is in part characterized in that its installation means include at least one upper support surface for acting as support against a lower support surface of the screen shoe.

According to the preferred embodiment, the installation means comprises locking means during rotation, including a central projection, for engaging itself inside a hole of a screen of the shoe, the shape of the central projection being complementary and adapted to the shape of said hole.

According to an additional characteristic, the blade comprises locking means for locking the blade on the snowshoe.

According to another characteristic, the locking means comprises a bar which rests on the upper surface of the screen of the snowshoe.

According to one embodiment of the blade, the bar includes a portion of a wall pivoting on a central projection.

According to an additional characteristic of the blade, it comprises two lateral walls fitted with a set of teeth. The lateral walls are arranged on both sides of a longitudinal plane of symmetry of the blade.

According to a variation of the embodiment of the blade, the lateral walls are parallel to the longitudinal plane of symmetry of the snowshoe at the time of installation.

Furthermore, the invention likewise concerns a snowshoe for receiving a removable blade, such as the one described below. The shoe has additional installation means for cooperating with the installation means of the blade.

Moreover, according to a variation of the embodiment, the snowshoe comprises locking means for locking the blade in position on the shoe.

One advantage of the present invention is that adjusts snowshoe traction for snow or ice conditions.

Another advantage resides in its removability.

FIG. 16 represents the shoe and a alternate embodiment of the blade in transverse section;

FIG. 17 represents in lateral view a second alternate embodiment of the blade; and

DETAILED DESCRIPTION OF THE PREFERRED EMBODIMENTS

Figure 1:
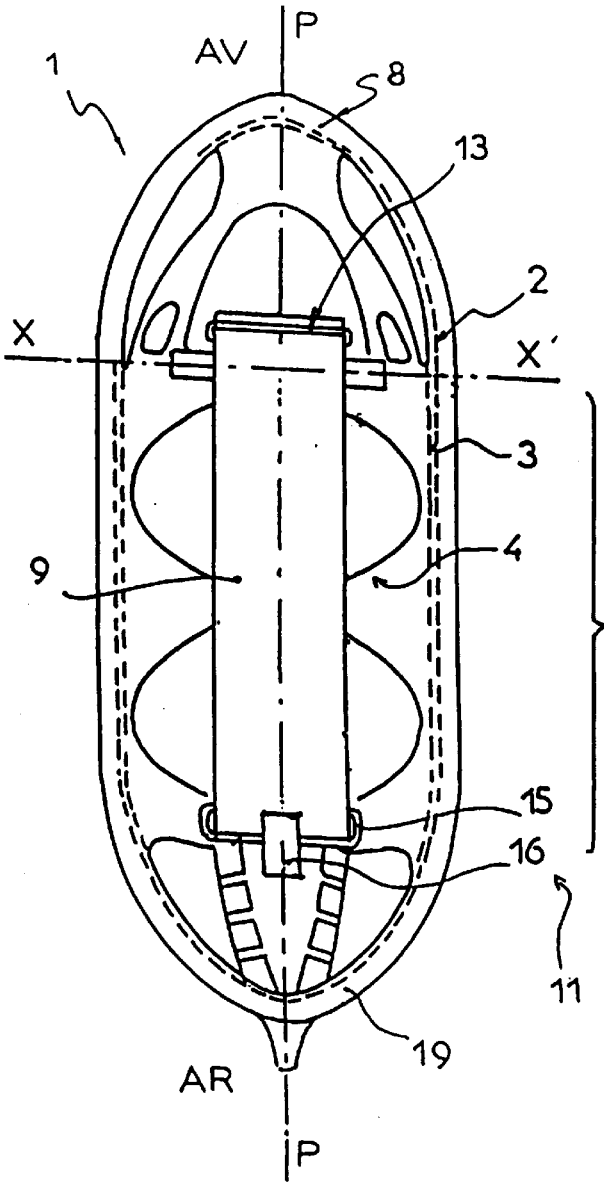
FIG. 1 is a top view of the snowshoe with its blade, but without the boot.

The snowshoe identified has the shape of a perforated plate, in a vertical plane of general symmetry (P) extends below a boot (6). The snowshoe has a main frame (2), including a peripheral wall (3) delimiting a lower zone or screen (4). A set of internal walls support a binding (5) for retaining the boot (6) of the user.

Said screen (4) with its ensemble of internal walls forms a general lower surface on the snow. Its relatively large support makes it possible that the user will not sink too deeply into the snow. It should be noted that the binding (5) for retaining the boot (6), by way of example, is articulated relative to the screen (4) of the snowshoe along a transverse axis (XX'). This enables the boot to be vertically pivoted as shown by (F1, F2). Beneficially, said binding (5) includes an articulated plate (9) carrying retention means for the boot, i.e. a front retention means (10) and rear retention means (11). Thus, a front extremity (12) of the boot is retained, for example, by a front or back strap (13), while the rear extremity (14) is retained thanks to a pivoting rear strap or clip (15), including a retention lever (16). It goes without saying that the retention means, front and rear, could also be reversed, i.e. that the front strap (13) could be placed in the rear and the rear strap (15) and its lever (16) could be placed in the front. The plate (9) is preferably rigid and extends longitudinally. It comprises an upper support surface (17) in order to support the sole of the boot. Of course, the snowshoe invention can be equipped with any other type of bindings for the boot, for example the one described in French Patent Application No. 94 05919 by applicant.

Figure 2:
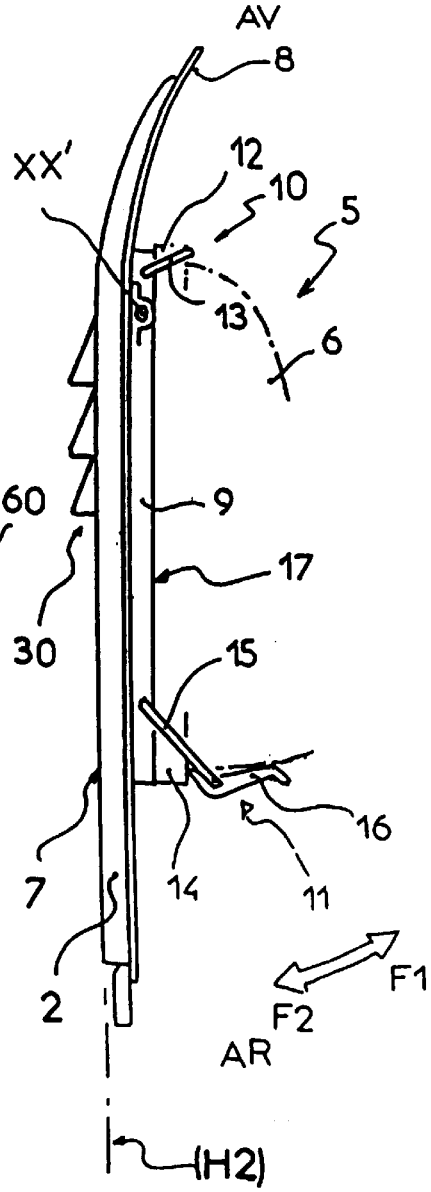
FIG. 2 is lateral view of the snowshoe of FIG. 1 with the boot being indicated by a dotted line.
Figure 3:
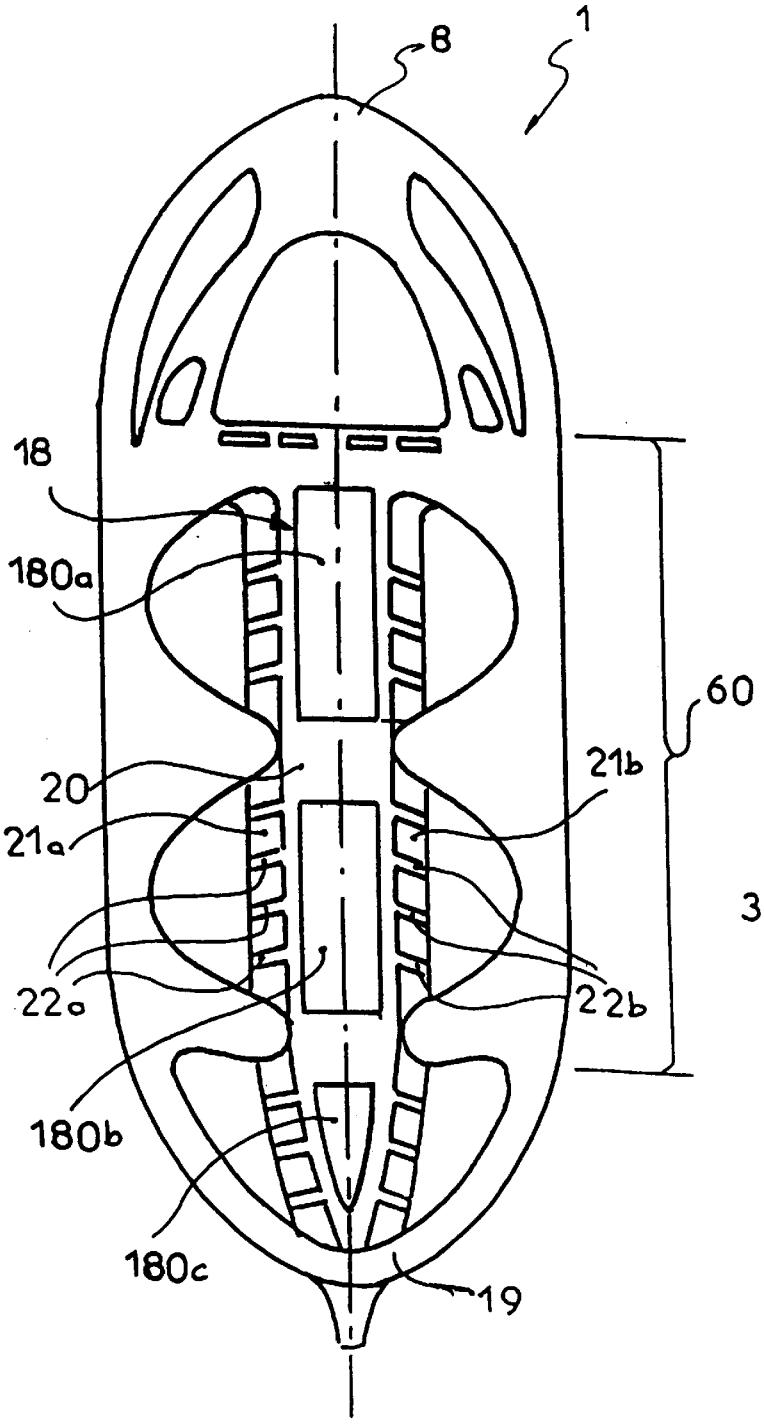
FIGS. 3 and 4 are similar view as FIGS. 1 and 2, illustrating the snowshoe alone without a binding and without the blade and in a different scale.
Figure 4:
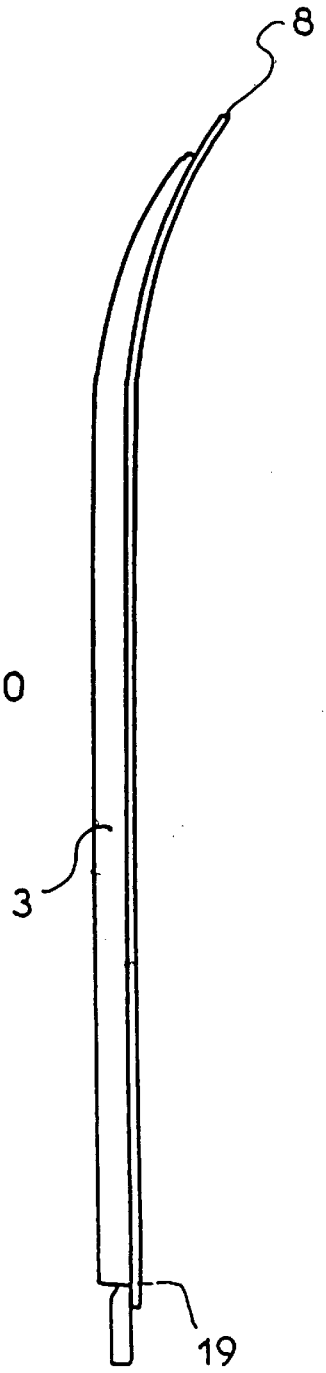
Figure 7:
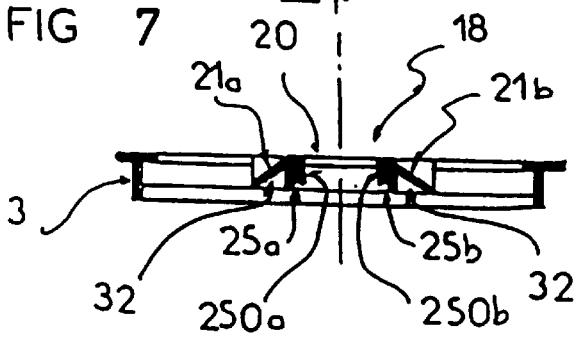
FIG. 7 is a view in traverse section along line VII—VII of FIG. 5.

According to one embodiment of the snowshoe on which the blade is to be mounted, the perforated plate has a generally elongated shape. Its front is preferably raised and of slightly pointed form to form a front spatula (8). Its central zone (60) is located below the boot (6) of the user and thus below the plate (9). In case a binding as illustrated in FIGS. 1 and 2, a longitudinal ridge (18), extends, for example, from a traverse axis of articulation of the plate (XX') up to the heel (19) of the snowshoe. Said longitudinal ridge (18) serves beneficially as support for the boot (6) or for the plate (9) in case of binding of the articulated plate type. It should be added that the longitudinal ridge (18) comprises a central horizontal support surface (21*b*). It should be noted that the two inclined surfaces (21*a*, 21*b*) converge in upward direction as depicted in FIG. 7.

Figure 6:
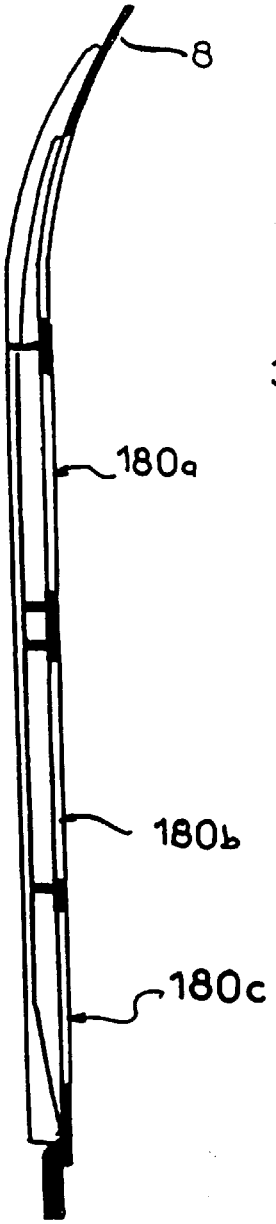
FIG. 6 is a view in longitudinal section along line VI—VI of FIG. 5.
Figure 5:
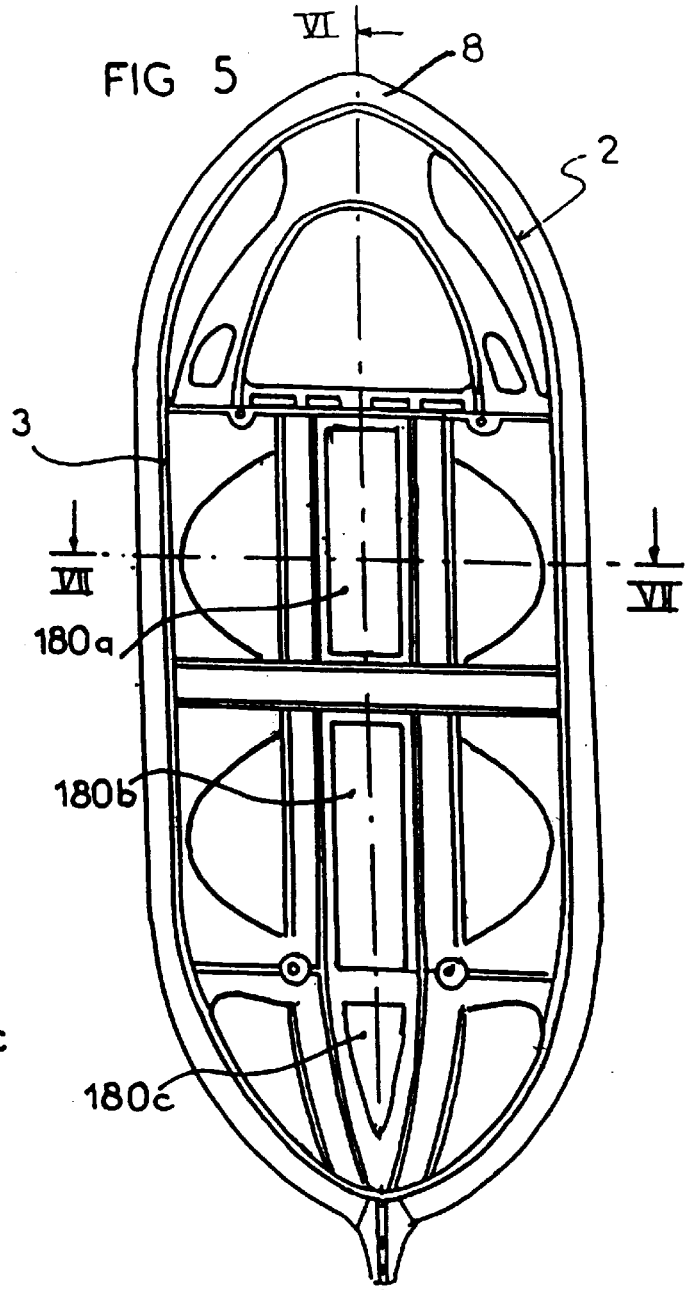
FIG. 5 is a bottom view of the snowshoe of FIG. 3.

As illustrated in FIGS. 5 and 6, the central surface (20) of the longitudinal ridge (18) defines at least one elongated hole (180*a*, 180*b*, 180*c*). In the represented mode, the longitudinal ridge comprises two lateral longitudinal projections (25*a*, 25*b*) extending in downward direction (BA) on both sides of the front hole (180*a*) and central hole (180*b*). It should be noted that the longitudinal ridge, its holes and its lateral extension constitute complementary installation means for cooperation with the installation means if the blade, described below. It goes without saying that the snowshoe could also have a different shape without going outside the claimed field of projection of the invention.

Figure 8:
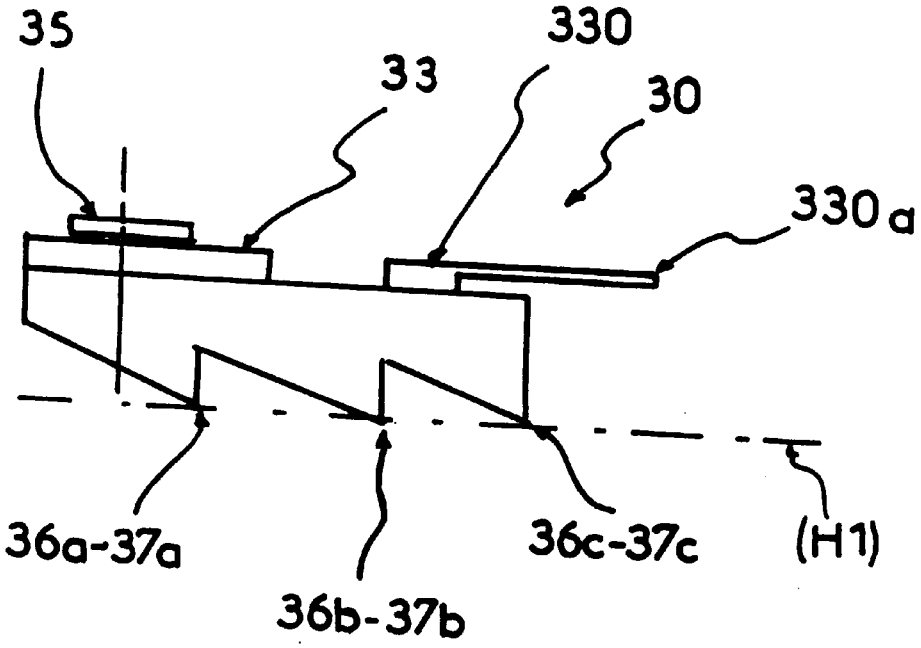
FIG. 8 is a lateral view of a blade alone.
Figure 9:
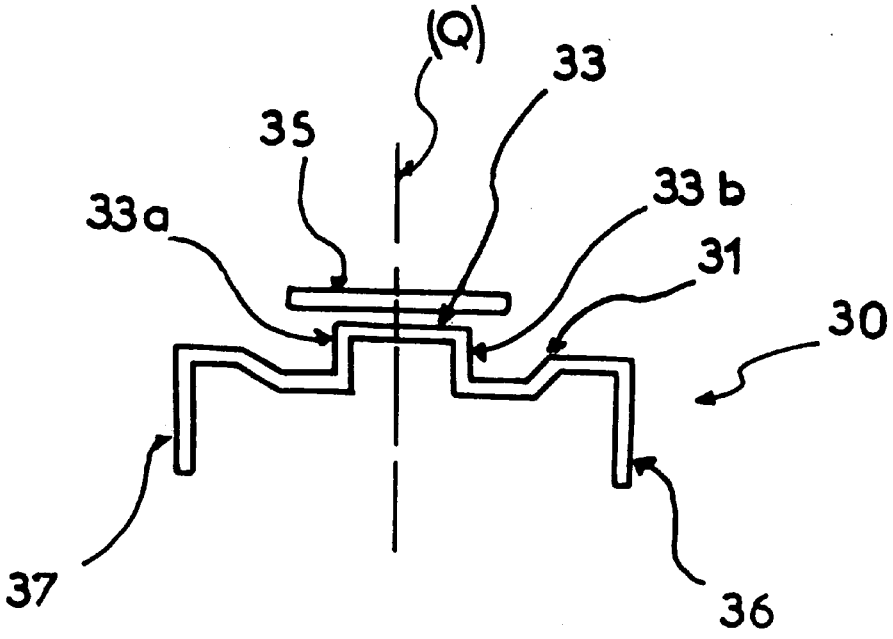
FIG. 9 represents a rear view of the blade of FIG. 8.

As illustrated in FIGS. 8 and 9, particular attention is drawn to a surface-holding means of the snowshoe in the snow, such as a blade (30), and, more specifically the installation means and the locking means for said blade (30) on the snowshoe (1). The blade (30) designed to be mounted on the snowshoe (1) in detachable fashion. It is beneficially constituted by a metal profile, such as of aluminum, for example. Needless to say, the blade could also be constructed of any other material sufficiently rigid and solid in order to ensure its surface-holding function on the snow without going outside the claimed field of protection of the invention.

According to the preferred embodiment , the blade (30) comprises installation means for engaging the snowshoe (1). It likewise comprises locking means for locking it in position on the snowshoe. The installation and locking are preferably effected in detachable manner.

Figure 13:
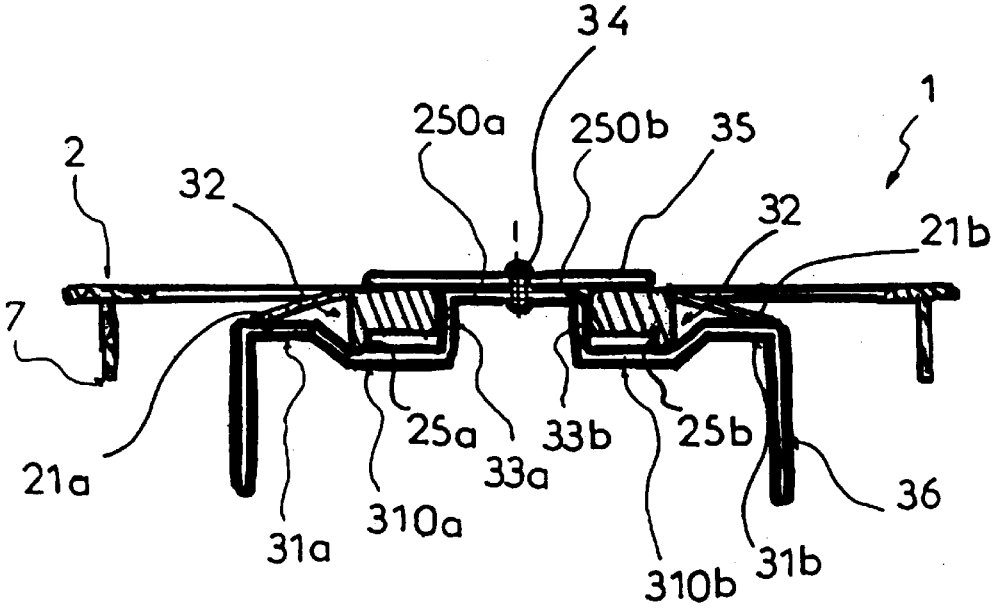
FIG. 13 is a sectional view depicting the blade installed on the snowshoe in transverse section.
Figure 14:
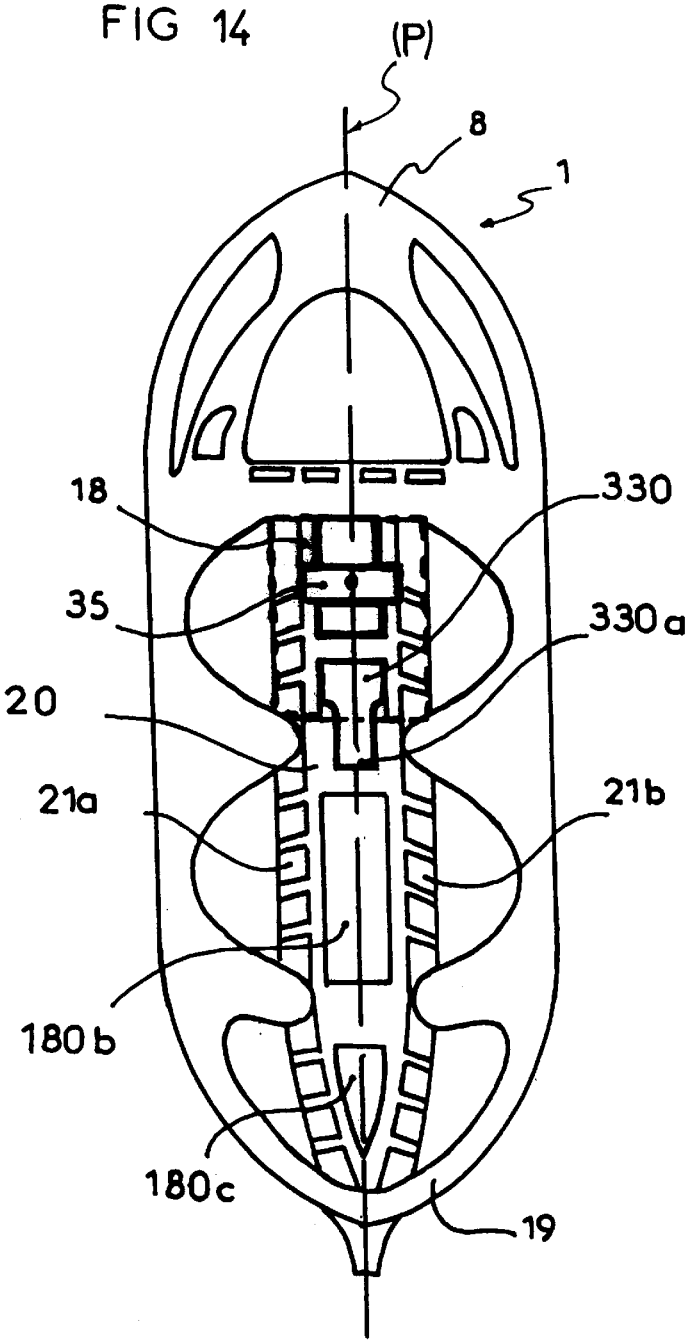
FIGS. 14 and 15 are identical views to FIGS. 3 and 6, respectively, depicting the shoe fitted with the blade.
Figure 15:
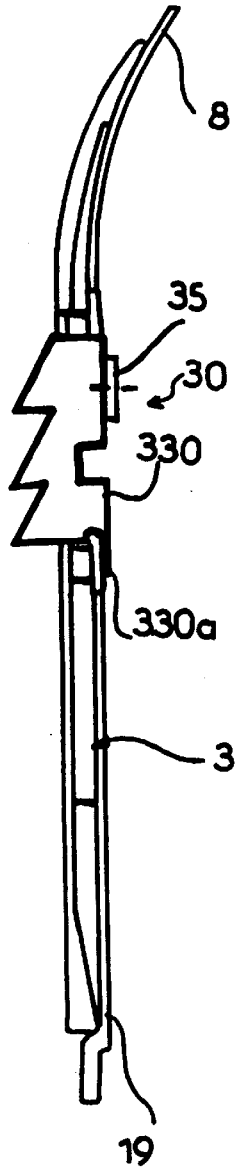

The installation means for the blade (30) include in part an upper support surface (31) for supporting itself in mating engagement with the lower support surface (320 of the screen (4). The lower support surface (31) of blade (30) and constitutes, in part, the complementary installation means of the snowshoe. It should be noted that the lower support surface (320 of the screen (4) is constituted by the lower end walls of the inclined surfaces (21*a*, 21*b*) and those of the longitudinal projections (25*a*, 25*b*). The upper support surface (31) of the blade (30) is formed by two lateral support surfaces (31*a*, 31*b* 310*a*, 310*b*) which respectively cooperate with the lower edges of the longitudinal projections (25*a*, 25*b*) and the inclined surfaces (21*a*, 21*b*) of the screen, as shown in FIG. 13. Of course, the upper support walls of the blade and the lower support walls of the screen which constitute the respective installation means of the snowshoe and the blade could be different and remain complementary without going outside the claimed field if projection of the invention.

Figure 10:
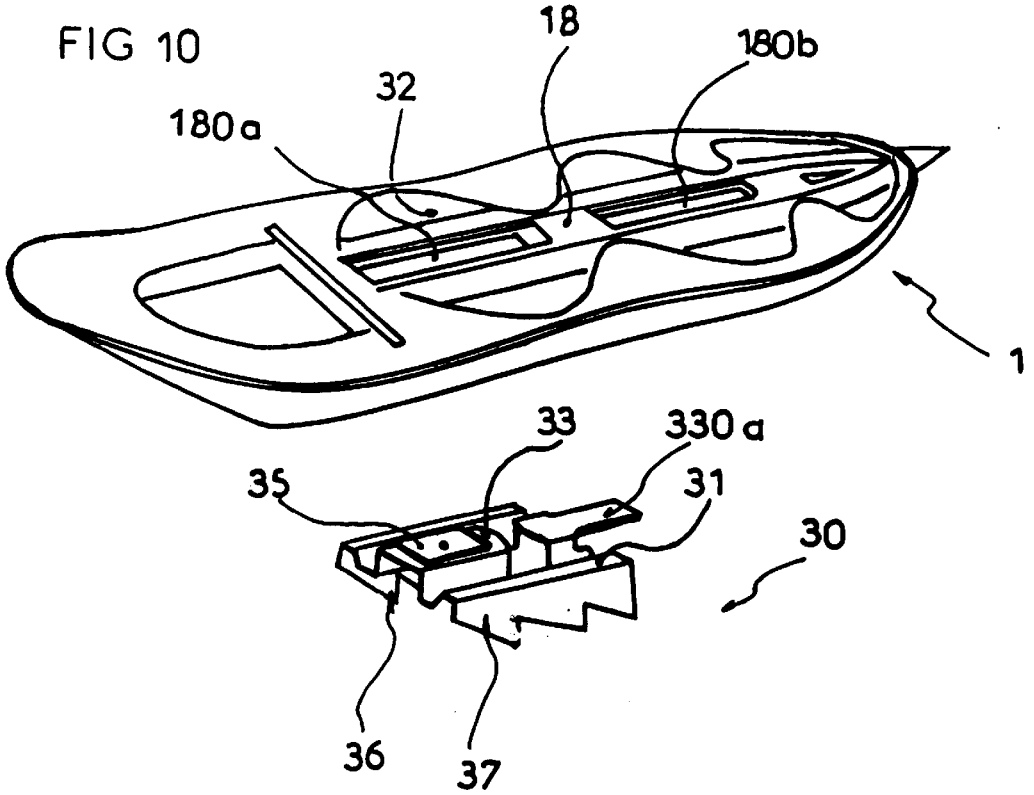
FIG. 10 is a perspective view depicting the shoe and the blade before installation.
Figure 11:
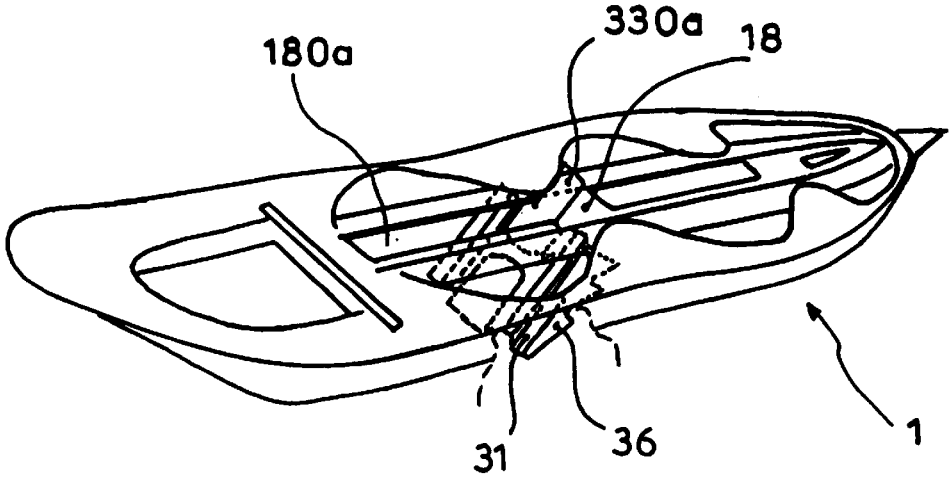
FIG. 11 is a perspective view depicting the shoe and the blade during installation.
Figure 12:
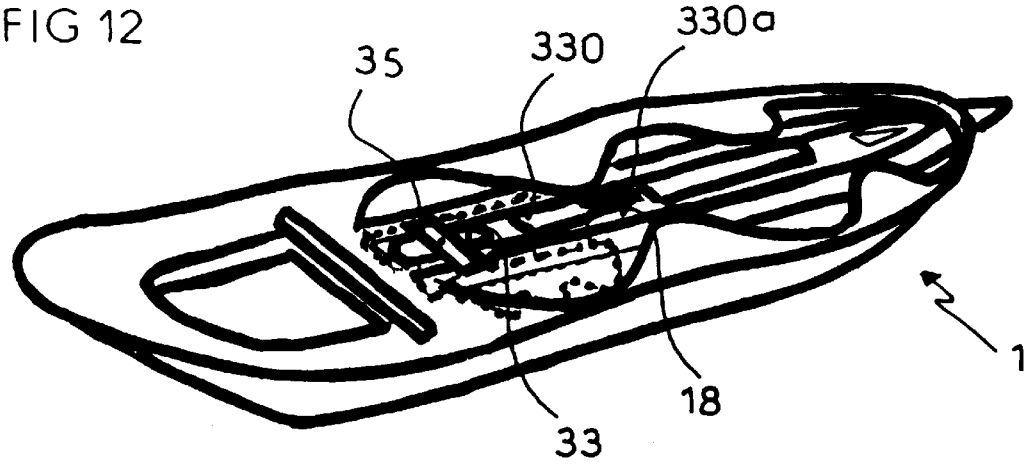
FIG. 12 is a perspective view depicting the shoe with the blade installed.

As illustrated in FIGS. 10, 11 and 12, the installation means of the blade and the snowshoe also include a blocking means for preventing rotation, which are constituted by a central projection (33) which is received in the front hole (180*a*). The blocking during rotation is effected by cooperation and thrust of the lateral fronts (33*a*, 33*b*) of the central projection (33) with the internal walls (250*a*, 250*b*) of the lateral projections (25*a*, 25*b*) which edge the front hole (180*a*). It should be noted that the shape of the central projection is complimentary and adjusted to the shape and the dimensions of the hole (180, 180*b*, 180*c*), which receives same in order to precisely block any pivoting of the blade in relationship to the snowshoe.

According to the preferred realization mode, the blade (3) comprises locking means, which permits its mounting on the snowshoe in removable fashion. The locking means are constituted in part by a bar (35) which rests on the upper face of the screen, i.e. on the central wall (20) of the longitudinal ridge (18) of the snowshoe and, more precisely, on the edges of its front hole (180*a*) . It should also be noted that the central projection (33) of the blade (30) is such that its upper wall (330) comprises a rear extension (330*a*) extending toward the rear, for receipt through the from hole (180*a*) in order to rest on the support surface (20) of the longitudinal ridge (18) as indicated in FIGS. 11 and 12. The rear extension (330*a*) thus permits the locking means of having two upper support zones on the screen of the snowshoe in order to maintain the upper support surface (31) of the blade (30) against the lower support surface (32) of the screen, as shown in FIG. 13.

It is important to note that the preferred embodiment of the blade, the snowshoe and their respective installation means, said means beneficially permit the blade to be engaged with the underside of the snowshoe.

According to the preferred embodiment, the bar (35) is pivotally mounted to a portion of the wall on the central projection (33) for rotation around an axis or axle (34). Of course, according to this embodiment, the bar (35) can likewise comprise tightening means. The post (34) can be threaded to cooperate with a small wing nut, for example in order to firmly lock the blade on the snowshoe and to eliminate all play between the two, which might impede the user during hid forward movement. It goes without saying, that the locking means could also be obtained by equivalent devices without going outside the limitations of the claimed field of the invention. Likewise, the locking means destined to lock the blade in its position can be arranged directly on the snowshoe and be constituted, for example, by a sliding type of bar.

As indicated in FIGS. 8 and 10, the blade (30) includes two lateral walls (35, 37) fitted with a series of teeth (36*a*, 36*b*, 36*c*, 37*a*, 37*b*, 37*c*). The lateral walls (36, 37) extend from the support walls (310*a*, 310*b*) and form with them a slightly right angle in a manner to extend vertically in downward direction as depicted in FIG. 9. They arranged parallel on both sides of a longitudinal plane of symmetry (Q) of the blade (30), beneficially in symmetrical fashion, said plane (Q) of blade (30) being destined to align with the general longitudinal plane (P) of symmetry of the snowshoe at time of installation of the blade on the shoe.

Figure 17:
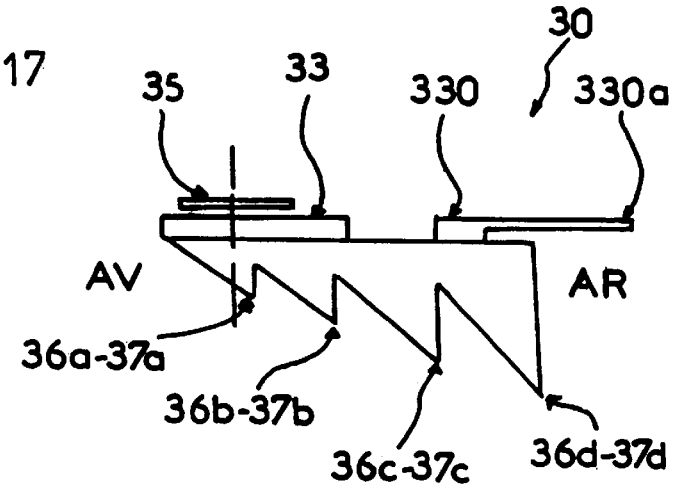

According to the preferred embodiment, the teeth (36*a*, 36*b*, 36*c*, 37*a*, 37*b*, 37*c*) of the lateral walls have the same size. Their extremities are located in a common horizontal plane (H1) as indicated in FIG. 8. It is, of course, obvious that the width of the teeth could be different from one wall to the other or even within the same wall. Thus, according to the embodiment illustrated in FIG. 17, the width of the teeth increases beneficially from the front (AV) to the rear (AR). It should be noted that the points of the teeth (36*a*, 36*b*, 36*c*, 36*d*, 37*a*, 37*b*, 37*c*, 37*d*) can thus be arranged either in the same plane or in several different planes, said planes being situated beneath a horizontal plane (H2) defined by the lower edge (7) of the frame (2).

According to the preferred embodiment, the positioning and installation on the snowshoe is effected as indicated in FIGS. 10 and 12. The central projection (33) in from hole (180*a*) in such manner so as to position the rear extension (330*a*) on the ridge wall portion (18) which separates the front hole (180*a*) from the central hole (180*b*). When all of the respective support surfaces (31, 32) are in position, it suffices to lock the blade with the aid of its pivoting bar (35).

It should be noted that the installation means and the blade locking means and the snowshoe can have a different configuration without going outside the protected field of the invention. Thus, the blade could, for example, be received from the top of the screen to ride on the longitudinal ridge, for example, the pivoting bar now locking the blade from the underside of the snowshoe.

In addition, to one specific embodiment, not represented, the blade could no longer be installed on the screen of the snowshoe but directly under the articulated plate of the binding. The installation means and means of locking the blade to the plate could be similar to those described earlier.

Figure 16:
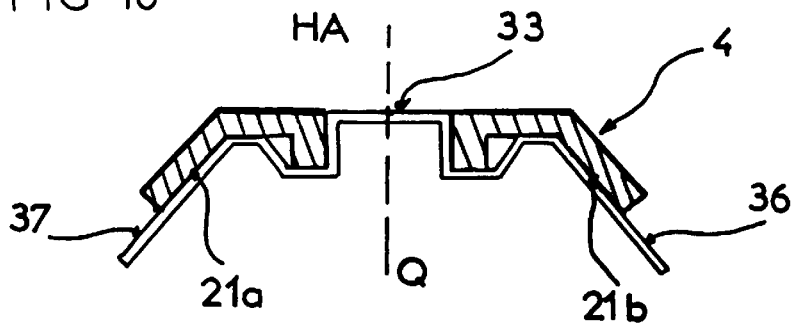
FIG. 16 to 18 illustrate alternative embodiment of the blade.

According to another variation of a specific embodiment, the lateral walls (36, 37) are inclined relative to the plane of symmetry (Q) of the blade in such a manner so as to converge toward the top (HA), as indicated in FIG. 16. According to this mode, the external front of the upper portions of said walls (36, 37) constitute a support wall for cooperating with the lower front of the inclined surfaces (21*a*, 21*b*) of the screen (4) which thus constitutes a lateral reinforcement for said walls.

Figure 18:
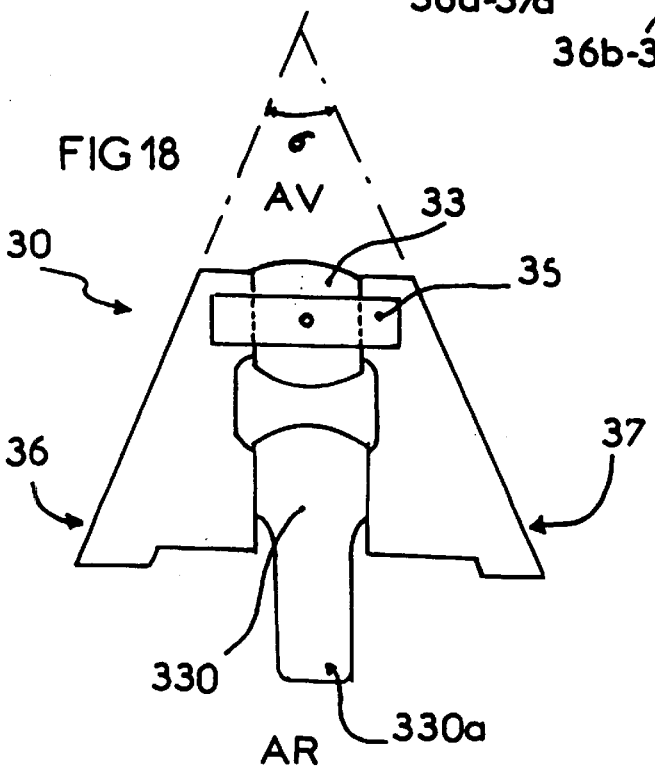

According to another embodiment of the blade illustrated in FIG. 18, the lateral walls (36, 37) are no longer arranged in parallel viv-a-vis the plane (Q) but are arranged in such manner so as to converge toward the front (AV). They thus form an angle (a) ranging from 0 to 60°, open to the rear (AR) in a longitudinal plane with plane (Q).

Needless to say, the inclination of the lateral walls, the number of teeth on said walls as well as their configuration could be different without going outside the claimed field of protection of the invention.

According to a non-represented mode, the blade comprises a transverse surface-holding wall connecting its lateral walls. The said transverse wall can likewise comprise a set if transverse or longitudinal teeth.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A blade for a snowshoe comprising:

an installation means for manual, tool-free installation and removal of the blade on a snowshoe such that the blade is mountable and detachable without the use of tools.

2. The blade for a snowshoe according to claim 1, wherein the installation means includes:

at least one upper support surface which engages a lower support surface of a screen of the snowshoe.

3. A blade assembly for a snowshoe, the blade assembly comprising:

an assembly body having at least one upper support surface configured to engage a lower surface of a showshoe deck;

at least one knife edge depending from the assembly body;

a quick connect installation assembly including:

a central projection extending from the assembly body, which central projection is configured for receipt in a hole of the snowshoe deck, a shape of the central projection being complementary to and matingly engageable with a shape of the hole such that the blade body is constrained against rotation.

4. The blade assembly for a snowshoe according to claim 3 wherein the installation assembly further includes:

a locking means mounted on the assembly body for locking the blade assembly to a snowshoe deck.

5. The blade assembly for a snowshoe according to claim 4 wherein the locking means comprises:

a bar which is configured to extend through the hole and engage an upper surface of the snowshoe deck.

6. A blade for a snowshoe, the blade comprising:

at least one upper support surface configured for engaging a lower surface of a snowshoe deck;

a central projection extending from the upper support surface, the central projection configured to be complementary to and matingly engageable with a shape of a hole in the snowshoe deck such that the central projection is constrained against rotational movement when attached to a snowshoe;

a toothed element extending below the upper support surface and the central projection;

a bar pivotally mounted on the central projection, the bar being pivotal to a first position in which it is configured to pass through the hole in the snowshoe deck and a second position which is configured to engage an upward surface of the deck when the blade is attached to a snowshoe.

7. The blade for a snowshoe according to claim 6 wherein the toothed element includes:

two lateral walls each fitted with a set of teeth, the lateral walls being arranged symmetrically on opposite sides of a longitudinal plane of symmetry of the blade.

8. The blade according to claim 6 wherein the lateral walls are parallel to the longitudinal plane of symmetry of the blade, the longitudinal plane of symmetry of the blade being adjustable with a longitudinal plane of symmetry of the snowshoe during the blade's installation.

9. A snowshoe for receiving the detachable blade according to claim 1, the snowshoe having complementary installation means which cooperates with the installation means of the blade.

10. The snowshoe according to claim 9 wherein the installation means includes:

a locking means for locking the blade on the snowshoe.

11. A device for selectively promoting traction on packed snow and ice for a snowshoe which includes a peripheral frame, a central longitudinally extending support structure, and a deck extending between the central support structure and the peripheral frame, the device comprising:

a blade element including a plurality of teeth which dig into compressed snow and ice; and, a manually operable twist-lock for selectively interconnecting the blade element to the central support structure of the snowshoe for use on packed snow and ice and for selectively removing the blade.

12. An apparatus for adapting a snowshoe to icy conditions, the snowshoe having a central support structure having a lower surface and an aperture having an interior surface of defined shape, the apparatus including:

a blade element, including teeth which dig into icy snow, the blade element having an upper surface which is configured to engage the snowshoe lower surface and a projection which is configured to matingly engage the interior surface of the aperture such that the blade is held against rotation; and, an interconnecting mechanism for (i) selectively locking the blade element projection into the aperture the upper blade element upper surface against the lower surface of the central support structure to adapt the snowshoe to icy conditions and (ii) selectively decoupling the blade.

13. The device as set forth in claim 12 wherein the interconnecting mechanism includes:

a bar which extends through the central support structure aperture and rotates into mating engagement with an upper surface of the central support structure.

14. An accessory for a snowshoe for adapting the snowshoe for icy conditions, the snowshoe including a peripheral frame, a central support structure having at least one aperture, and a deck extending between the central support structure and the peripheral frame, the accessory including:

a body which defines upper support surfaces adapted to engage a lower surface of the snowshoe and oppositely extending elements which are configured to cut into ice and crusty snow;

a rotating bar located toward one end of the body and extending beyond the upper support surfaces, the bar rotating between at least a first position in which it passes through the central support structure aperture and a second position for mating engagement with a mating surface of the central support structure; and, a tab toward an opposite end of the body for extending through the central support structure aperture and engaging an engaging surface of the central support structure.

15. The blade according to claim 1 wherein the installation means includes:

a tab which is configured to be manually inserted through a snowshoe and engage an upper surface thereof;

a turn element which is configured to be manually turned between a release position for permitting detachment of the blade and a locking position adapted to engage the snowshoe upper surface for locking the blade to a snowshoe.

* * * * *